US007112076B2

(12) United States Patent
Wu

(10) Patent No.: US 7,112,076 B2
(45) Date of Patent: Sep. 26, 2006

(54) CABLE ASSEMBLY HAVING IMPROVED PULLING TAB

(75) Inventor: Jerry Wu, Irvine, CA (US)

(73) Assignee: Hon Hai Precisiion Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/917,159

(22) Filed: Aug. 11, 2004

(65) Prior Publication Data

US 2006/0035496 A1 Feb. 16, 2006

(51) Int. Cl.
*H01R 13/62* (2006.01)

(52) U.S. Cl. ..... 439/160

(58) Field of Classification Search ..... 439/484, 439/160

See application file for complete search history.

(56) References Cited

U.S. PATENT DOCUMENTS 6,126,479 A * 10/2000 Lee ..... 439/484
6,331,122 B1 * 12/2001 Wu ..... 439/567
6,500,023 B1 * 12/2002 Duong et al. ..... 439/484
D482,333 S * 11/2003 Hisamatsu et al. ..... D13/147

* cited by examiner

*Primary Examiner*—Briggitte R. Hammond
(74) *Attorney, Agent, or Firm*—Wei Te Chung

(57) ABSTRACT

A cable assembly (100) includes a first connector (1), a cable (3) and a second connector (2) both electrically connecting to the first connector, and a pulling tab (5). The first connector includes an insulating housing (10) having an aperture (107) at a first end (102*c*), and a lock at a second end (102*d*) opposite to the first end. The pulling tab includes a stop at a first end (51) and a latch at a second end (52). The latch passes through the aperture and engages with the lock. The stop does not pass through the aperture. The pulling tab is thus reliably attached to the housing of the first connector.

14 Claims, 8 Drawing Sheets

CABLE ASSEMBLY HAVING IMPROVED PULLING TAB

BACKGROUND OF THE INVENTION

1. Field of the Invention

The present invention generally relates to a cable assembly, and more particularly to a cable assembly having an improved pulling tab.

2. Description of Related Art

It is well known that a cable assembly comprises a cable connector and a cable electrically terminated to the cable connector. The cable assembly is mateable with a complementary connector for transmitting signals from the cable to the complementary connector.

However, a panel of a chassis to which the complementary connector is mounted may have so many components mounted thereon that it is difficult to grasp the cable assembly when a user wants to separate the cable assembly from the complementary connector. Thus, many different kinds of pull mechanism are designed to solve this problem. A conventional pull mechanism generally includes a handle and a pair of retaining portions formed at two opposite ends of the handle and having the same structures. Furthermore, the pair of retaining portions are simultaneously inserted into and interlock with transverse ends of a housing. Therefore, the pair of retaining portions might likely fall off two ends of the housing thereby resulting in malfunction of the pull mechanism Hence, it is desired to provide an improved pull mechanism to avoid the foregoing drawbacks.

SUMMARY OF THE INVENTION

Accordingly, a main object of the present invention is to provide a cable assembly having a pulling tab which can be reliably assembled to the cable assembly and is simple in structure.

In order to achieve the object set forth, a cable assembly in accordance with the present invention comprises a first connector, a cable and a second connector both electrically connecting to the first connector, and a pulling tab attached to the first connector. The first connector comprises a first insulating housing having opposite first and second transverse ends. An aperture and an opening are respectively defined along a front-to-back direction in the first and the second transverse ends. A pair of limiting projections are formed on top and bottom surfaces of the aperture and projects into the aperture. A locking projection is disposed in an inner side surface of the opening and projects into the opening. The pulling tab has opposite first and second ends. The first end has a bulge projecting beyond a top and a bottom surfaces thereof for abutting against the limiting projections, a pair of positioning ridges protruding from the top and the bottom surfaces thereof, and a pair of recesses each formed between a corresponding bulge and a corresponding positioning ridge. A through slit is defined below each positioning ridge for enhancing flexibility of the ridge. The second end has a rachet disposed at an outer side thereof for engaging with the locking projection, a pushing protrusion spaced from the rachet along a back-to-front direction, and a groove formed between the rachet and the pushing protrusion.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
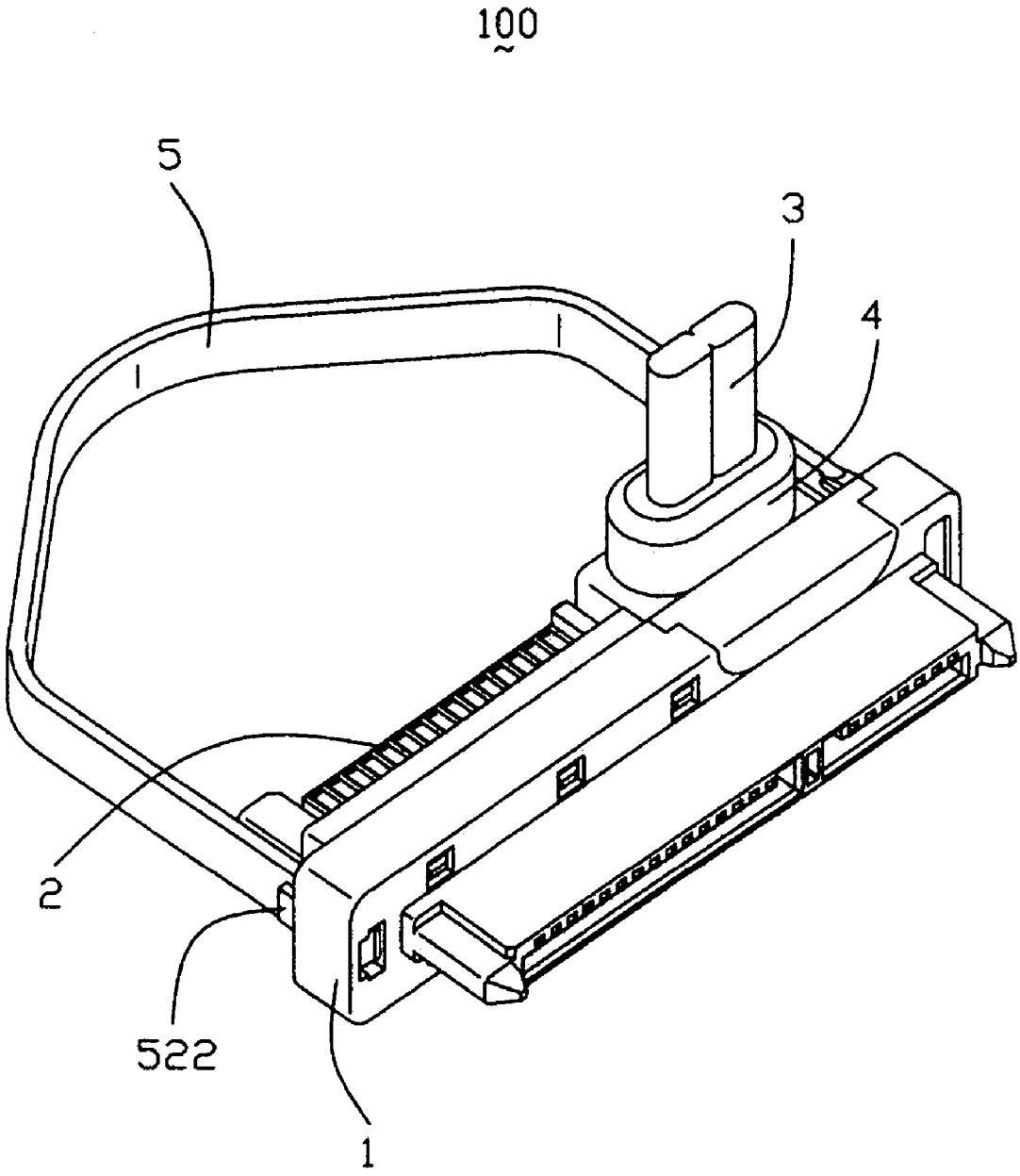
FIG. 1 is an assembled, perspective view of a cable assembly in accordance with the present invention.
Figure 2:
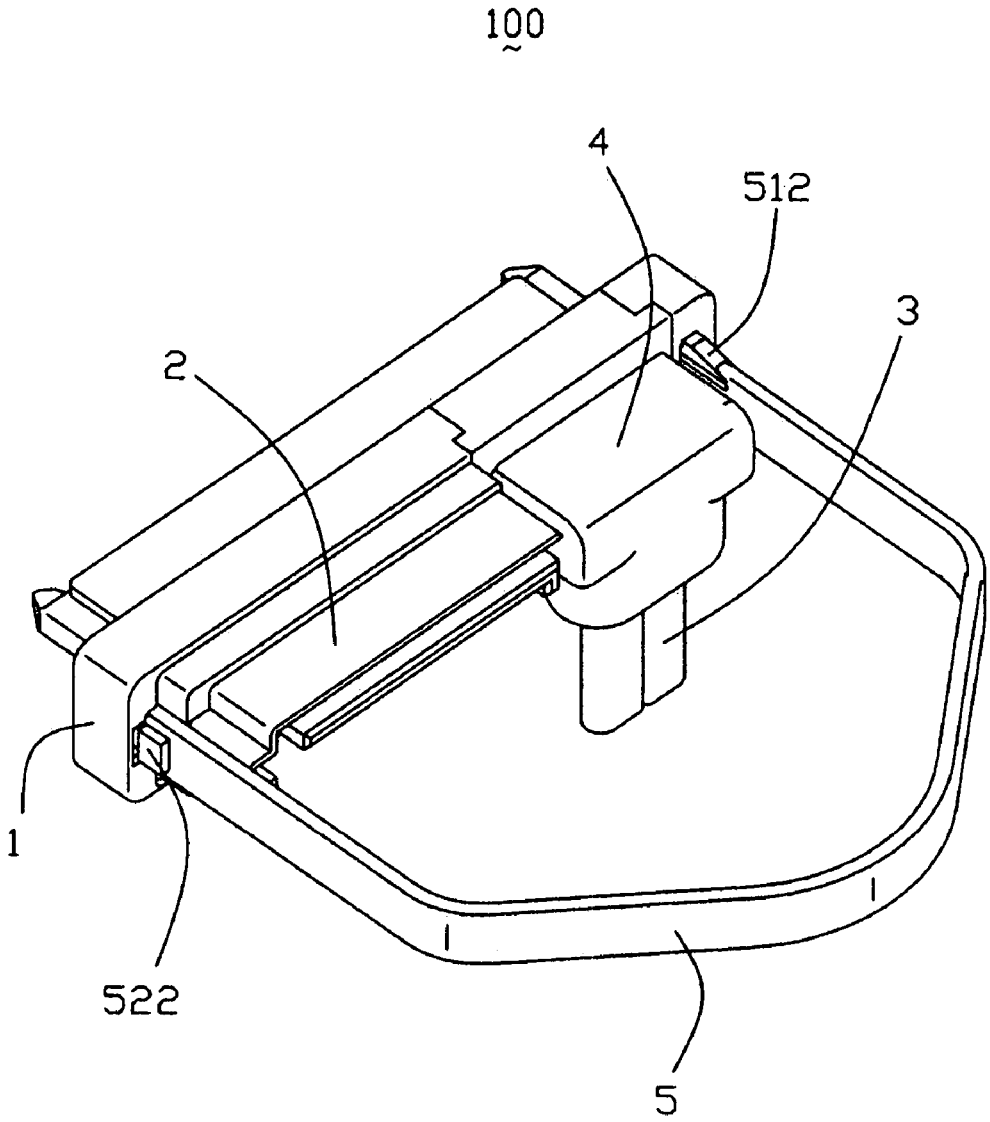
FIG. 2 is a view similar to FIG. 1, but taken from rear and bottom aspects.

Referring to FIGS. 1 and 2, a cable assembly 100 in accordance with the present invention comprises a first connector 1, a second connector 2 back to back assembled to the first connector 1, a cable 3 terminated to the first connector 1, a cover 4 overmolded with the cable 3 and the first connector 1, and a pulling tab 5 attached to the first connector 1. In a preferred embodiment, the first connector 1 is a Serial Advanced Technology Attachment (Serial ATA) receptacle connector. The second connector 2 is a Serial ATA plug connector. The cable 3 is a standard Serial ATA cable.

Figure 3:
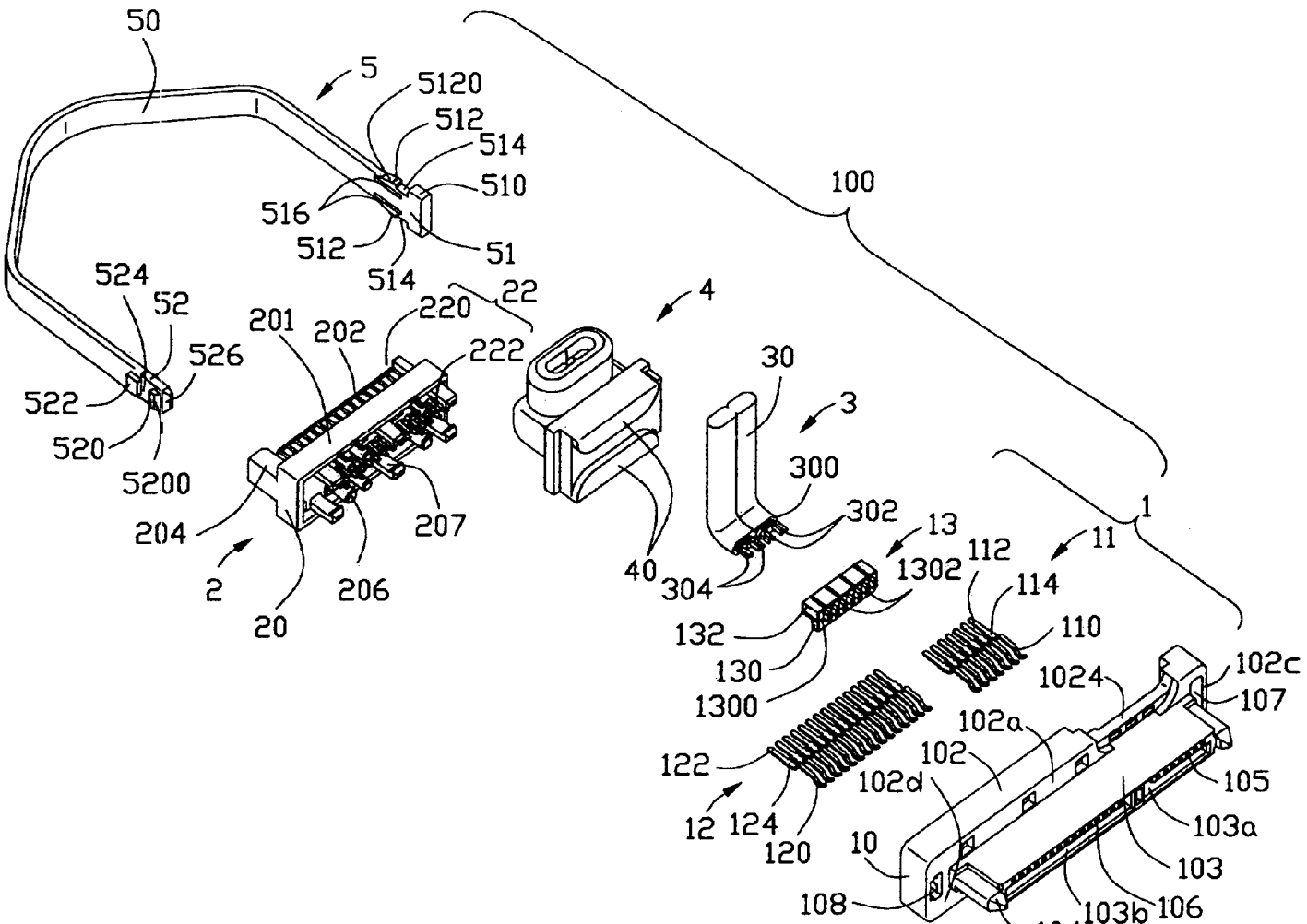
FIG. 3 is an exploded, perspective view of the cable assembly of FIG. 1.
Figure 4:
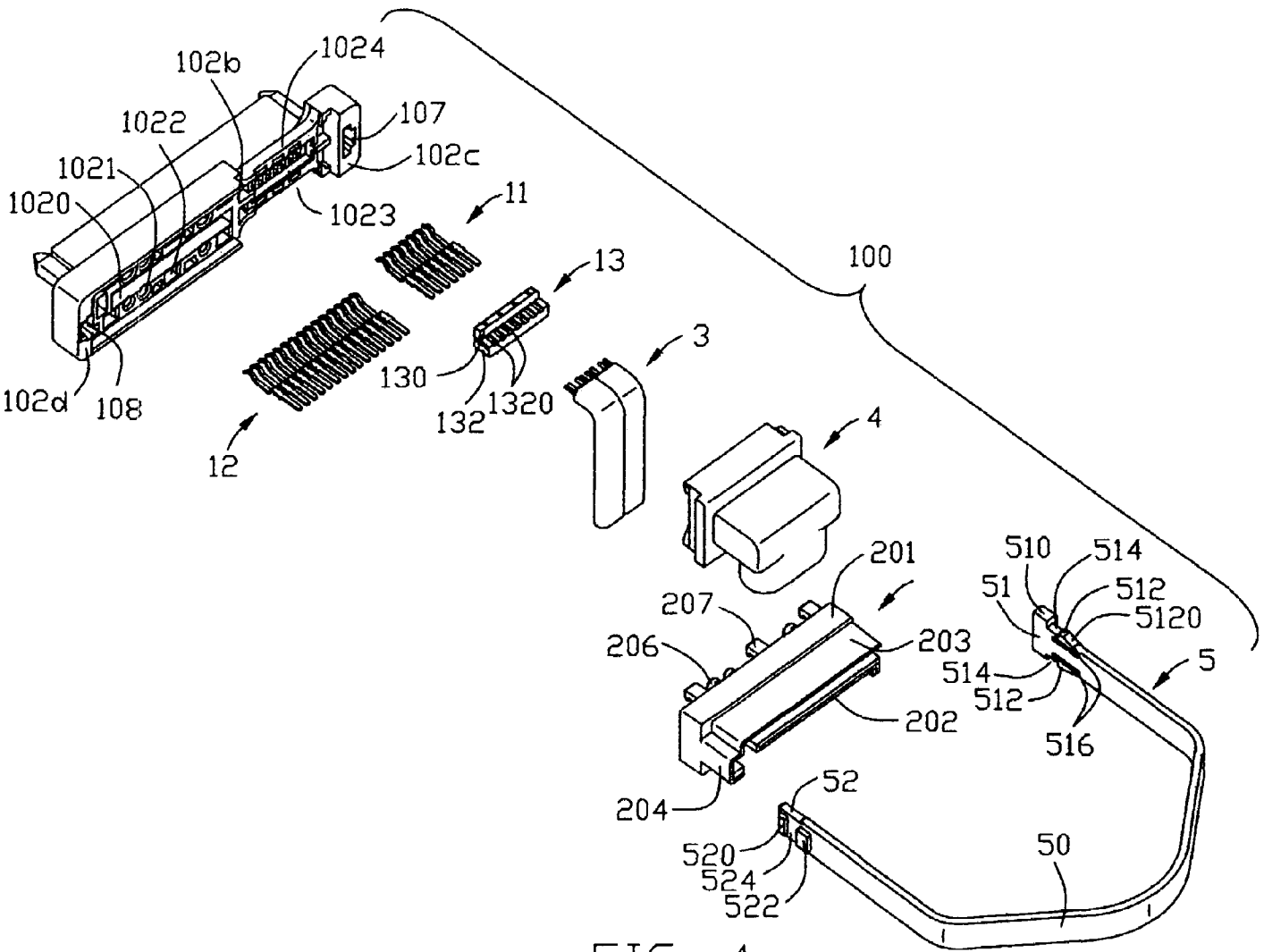
FIG. 4 is an exploded, perspective view of the cable assembly of FIG. 2.
Figure 5:
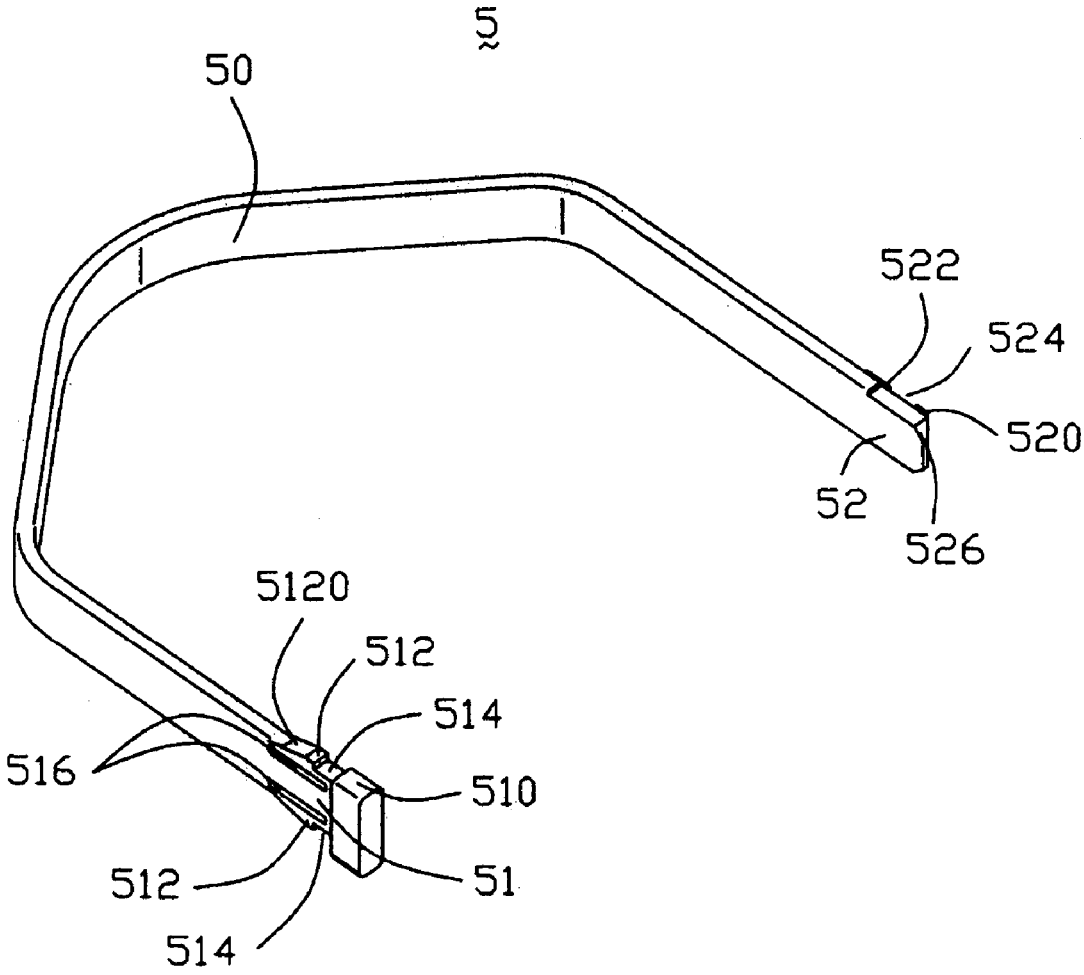
FIG. 5 is an enlarged, perspective view of a pulling tab of the cable assembly of FIG. 3, but taken from a bottom aspect.
Figure 6:
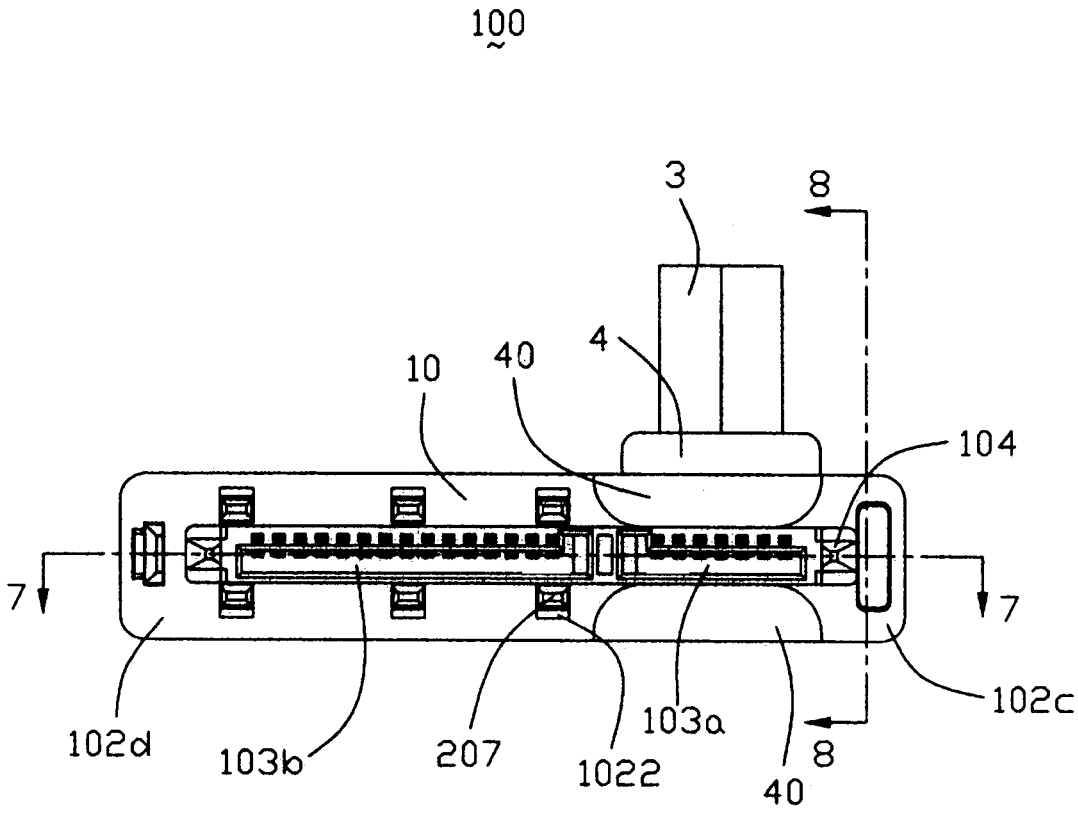
FIG. 6 is a front, plane view of the cable assembly of FIG. 1.
Figure 7:
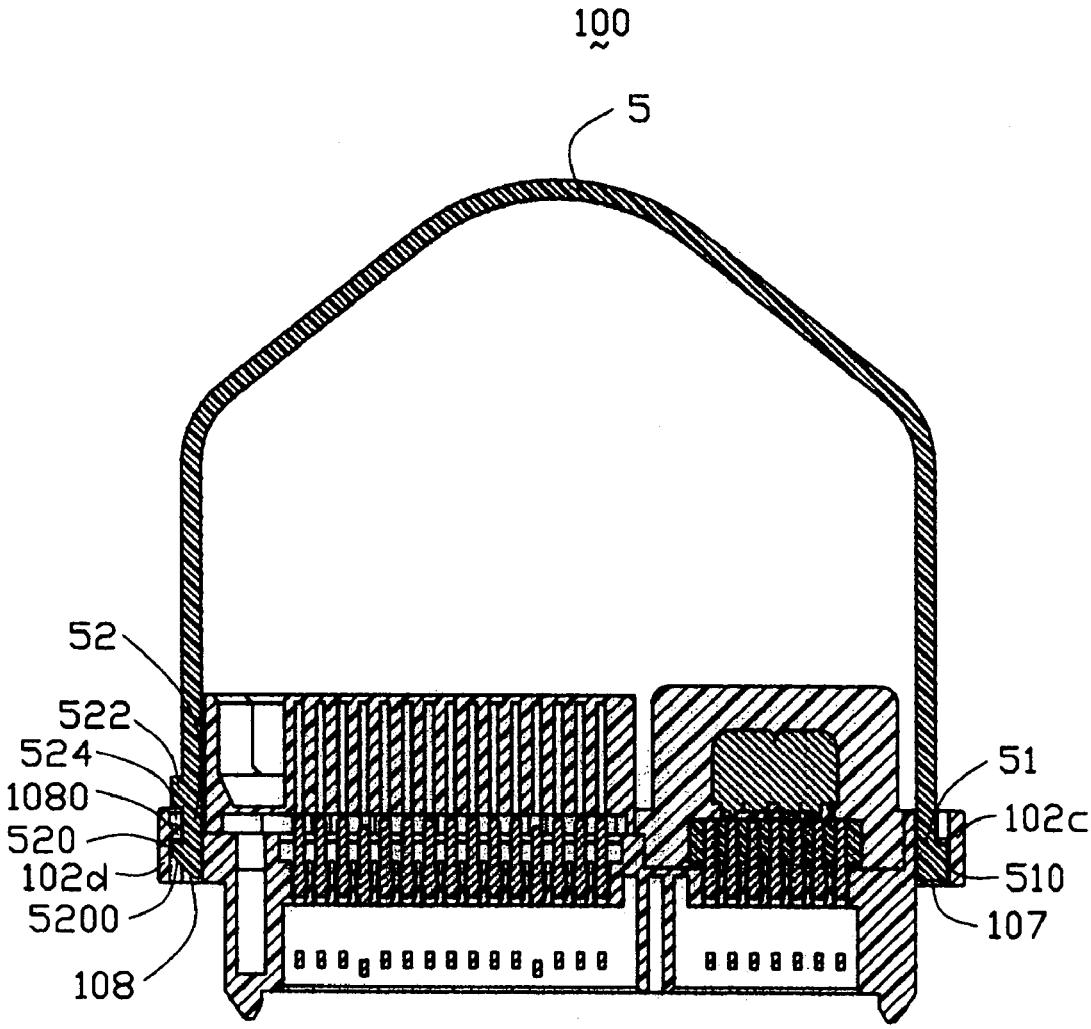
FIG. 7 is a cross-sectional view taken along line 7—7 of FIG. 6.
Figure 8:
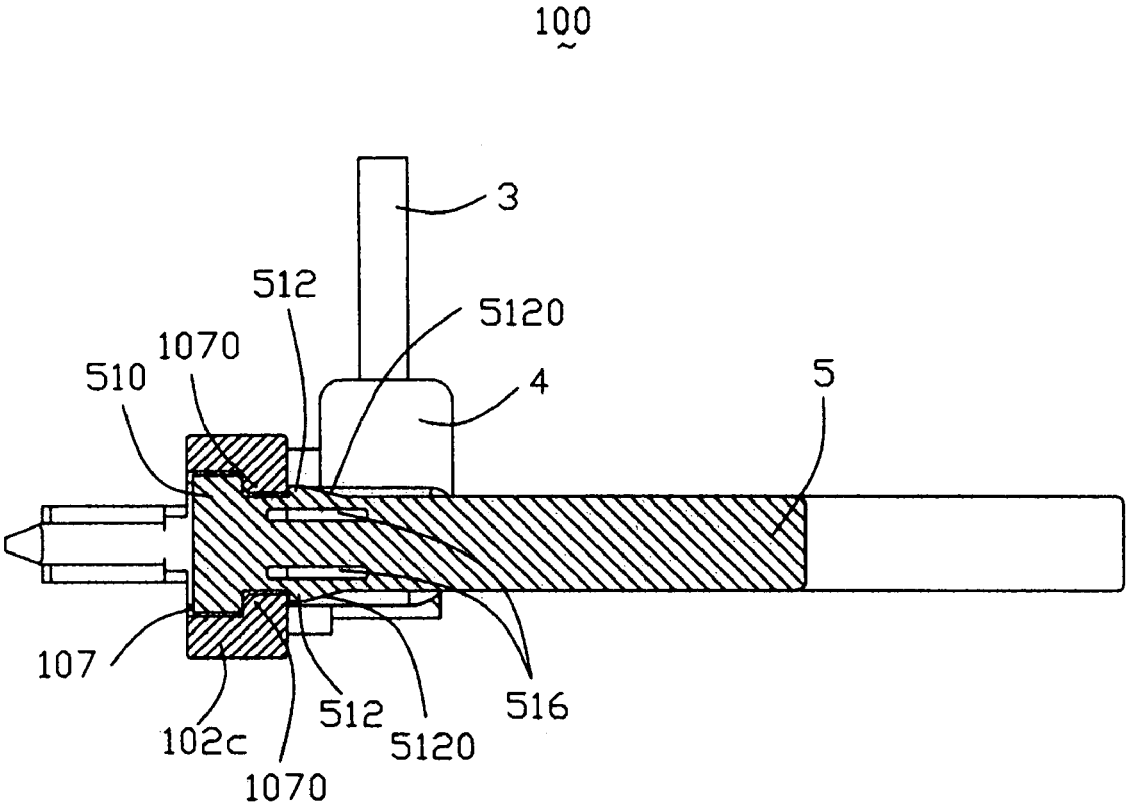
FIG. 8 is a cross-sectional view taken along line 8—8 of FIG. 6.

Referring to FIGS. 3, 4 and 6 in conjunction with FIGS. 7 and 8, the first connector 1 comprises a first insulating housing 10, a plurality of first and second receptacle contacts 11, 12 retained in the first housing 10, and a spacer 13 for positioning the first receptacle contacts 11.

The first housing 10 has an elongated base 102 and a mating section 103 extending perpendicularly and forwardly from a front face 102*a* of the base 102. A pair of guiding posts 104 is disposed at opposite ends of the mating section 103 for guiding the first connector 1 to mate with a first complementary connector (not shown). The mating section 103 includes a first and a second mating ports 103*a*, 103*b* arranged in a side-by-side manner wherein the first mating port 103*a* has a lengthwise dimension smaller than that of the second mating port 103*b*. The base 102 defines a cavity 1020 extending therethrough to communicate with the second mating port 103*b*, and a plurality of holes 1021 and slots 1022 located at upper and lower sides of the cavity 1020. The base 102 defines a receiving space 1023 corresponding to the first mating port 103*a* in a rear face 102*b* thereof, and a pair of depressions 1024 communicating with the receiving space 1023 in top and bottom faces thereof. The first housing 10 defines a plurality of first passageways 105 communicating with the first mating port 103*a* and the receiving space 1023, and a plurality of second passageways 106 communicating with the second mating port 103*b* and the cavity 1020. The base 102 of the first housing 10 has a first transverse end 102*c* and a second transverse end 102*d* opposite to the first transverse end 102*c*. An aperture 107 and an opening 108 are respectively defined along a front-to-back direction in the first transverse end 102*c* and the second transverse end 102*d*. A pair of limiting projections 1070 (as shown in FIG. 8) are formed on top and bottom surfaces of the aperture 107 and projects into the aperture 107. A locking projection 1080 (as shown in FIG. 7) is disposed in an inner side surface of the opening 108 and projects into the opening 108. The opening 108 and the locking projection 1080 formed in the opening 108 together form a lock (not labeled) for locking one end of the pulling tab 5 with the second transverse end 102*d* of the first housing 10.

The first and the second receptacle contacts 11, 12 are assembled into the first and the second passageways 105, 106, respectively. The first receptacle contacts 11 has four signal contacts and three ground contacts, and each includes an engaging portion 110 received in the first mating port 103*a*, a tail portion 112 rearwardly extending out of the base 102 for connecting to the cable 3, and an intermediate portion 114 interconnecting the engaging portion 110 with the tail portion 112. The second receptacle contacts 12 has nine power contacts and six ground contacts, and each includes a contact portion 120 received in the second mating port 103*b*, a connecting portion 122 extending rearwardly beyond the cavity 1020, and a middle portion 124 interconnecting the contact portion 120 and the connecting portion 122.

The spacer 13 has a stepped configuration and comprises a stop block 130 defining a row of through holes 1300 for allowing the tail portions 112 of the first receptacle contacts 11 to pass therethrough, and a supporting base 132 extending rearwardly from the stop block 130 for supporting the tail portions 112 of the first receptacle contacts 11. The stop block 130 of the contact spacer 3 can prevent plastic from entering into the first passageways 105 of the insulative housing 1 during the over-molding of the cover 4. The stop block 130 provides a plurality of positioning protrusion 1302 projecting from a front face of the stop block 130. The supporting base 132 defines a plurality of slots 1320 in a bottom surface thereof and communicating with corresponding through holes 1300.

The second connector 2 comprises a second insulating housing 20 and a plurality of third plug contacts 22 retained in the second housing 20. The second housing 20 includes a body portion 201, an L-shaped mating tongue 202 extending rearwardly from a middle portion of the body portion 201 for mating with a second complementary connector (not shown), a base plate 203 extending rearwardly from the body portion 201 and parallel to the mating tongue 202 for latching with the second complementary connector, and a guiding portion 204 extending rearwardly from the body portion 201 and connecting with the base plate 203. The body portion 201 is formed with a plurality of rearwardly extending posts 206 and latches 207 for being received in the holes 1021 and the slots 1022 of the first housing 10, respectively. Each third plug contacts 22 comprises a first mating portion 220 received in the mating tongue 202 for engaging with the second complementary connector, and a second mating portion 222 for contacting with the connecting portion 122 of a corresponding second receptacle contact 12.

The cable 3 comprises a pair of wires 30 each include an insulating jacket 300, a pair of differential signal conductors 302 and a pair of ground conductors 304 exposed out of the jacket 300 at one end thereof.

Four signal conductors 302 of the cable 3 are respectively soldered with the tail portions 112 of the four signal contacts 11 of the first connector 1. One of the ground conductors 304 of each wire 30 is soldered with the tail portion 112 of a corresponding ground contact 11 of the first connector 1, other two ground conductors 304 of the wires 30 are soldered to a common ground contact 11 of the first connector 1.

The cover 4 is overmolded with the cable 3 and the first housing 10 after the wires 30 are soldered with the first contacts 11, and the cable 3 is positioned perpendicular to the first housing 10. The cover 4 has a pair of protrusions 40 received in the depressions 1024 of the first housing 10.

The second connector 2 is back to back assembled to the first connector 1 with the posts 206 received in the holes 1021 of the first housing 10 and with the latches 207 latching with corresponding slots 1022 thereby interlocking the first connector 1 with the second connector 2. The second mating portions 222 of the third plug contacts 22 extend into the cavity 1020 of the first housing 10 and resiliently contact with the connecting portions 122 of the second receptacle contacts 12, respectively. The cable assembly 100 is thus formed.

It can be understood that the cable assembly 100 is formed by integrating a cable connector with a power adaptor, wherein the cable connector comprises the first contacts 11 received in the first mating port 103*a* of the first housing 10 and the cable 3 electrically connecting with the first contacts 11 for signal transmission, and wherein the power adaptor includes the second contacts 12 received in the second mating port 103*b* of the first housing 10 and the second connector 2 electrically connecting with the second contacts 12 for power transmission.

Referring to FIG. 3–5, 7 and 8, the pulling tab 5 is preferably made of nylon material, and is flexible and is not easy to occur a permanent distortion. The pulling tab 5 comprises a substantially semiellipse-shaped handle 50 for facilitating detaching the cable assembly 100 from the complementary first connector. The pulling tab 5 has two opposite first and second ends 51, 52. The first end 51 has a stop (not labeled) comprising a bulge 510 projecting beyond a top and a bottom surfaces of the first end 51 for preventing the first end 51 from being pulled out of the first transverse end 102*c* of the first housing 10, a pair of positioning ridges 512 protruding slightly from the top and the bottom surfaces of the first end 51 for positioning the first end 51, and a pair of recesses 514 each formed between the bulge 510 and the positioning ridge 512 for receiving the limiting projection 1070. The bulge 510 extends outwardly beyond an outer side of the first end 51. Each positioning ridge 512 has a sloped surface 5120 facing toward a rear of the first end 51 for facilitating the pair of limiting projections 1070 to pass therethrough. A through slit 516 is defined below each positioning ridge 512 for enhancing flexibility of the ridge 512. The second end 52 has a latch (not labeled) comprising a rachet 520 disposed at an outer side of the second end 52 for engaging with the locking projection 1080 to prevent the second end 52 from falling off the second transverse end 108 of the first housing 10, a pushing protrusion 522 spaced from the rachet 520 along a back-to-front direction for stop the second end 52 from further extending forwardly, and a groove 524 defined between the rachet 520 and the pushing protrusion 522. The rachet 520 is in a wedged shape and has a bevel 5200 at a front end thereof for facilitating the locking projection 1080 of the first housing 10 to pass therethrough. The second end 52 has a cone-shaped post 526 at a free end thereof for guiding the second end 52 to insert.

In the preferred embodiment, the bulge 510 of the first end 51 of the pulling tab 5 and the pair of limiting projections 1070 of the first transverse end 102*c* of the first housing 10 are disposed along a vertical direction, while the rachet 520 of the second end 52 of the pulling tab 5 and the locking projection 1080 of the second transverse end 102*d* of the first housing 10 are disposed along a horizontal direction, so the second end 52 of the pulling tab 5 may pass through the first transverse 102*c* of the first housing 10 but cannot pass through the second transverse 102*d* of the first housing 10.

In assembly, the second end 52 of the pulling tab 5 is inserted into the aperture 107 of the first transverse end 102*c* of the first housing 10 from the front face 102*a* and extends through the aperture 107 till the pair of the limiting projections 1070 slide over the pair of positioning ridges 512 of the first end 51 of the pulling tab 5 and are received in the pair of recessed 514. At this time, the bulge 510 abuts against the limiting projections 1070 and is blocked by the limiting projections 1070 so that the first end 51 cannot further extend rearwardly. Then the second end 52 of the pulling tab 5 is inserted into the second transverse end 102*d* of the first housing 10 by forwardly pushing the pushing protrusion 522. The locking projection 1080 slides over the rachet 520 and engages with a rear side of the rachet 520. The locking projection 1080 is received in the groove 524. The pulling tab 5 is thus reliably assembled onto the first housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing having a plurality of contacts mounted therein, the housing having an aperture at a first end, and a lock at a second end opposite to the first end, and said lock of the housing comprising an opening and a locking projection projecting into the opening; and a pulling tab attached to the housing and including a stop at a first end and a latch at a second end;

wherein the latch comprises a rachet disposed at an outer side of said second end of the pulling tab for engaging with said locking projection to prevent said latch from falling off the second end of the housing, and passes through the aperture and engages with the lock; and wherein the stop is retained in the first end of the housing.

2. The electrical connector as claimed in claim 1, wherein said latch of the pulling tab extends through said aperture along a front-to-back direction from a front face of the housing, and engages wit said lock along a back-to-front direction.

3. The electrical connector as claimed, in claim 1, wherein said latch of the pulling tab further comprising a pushing protrusion spaced from said rachet along a back-to-front direction for positioning said latch, and a groove formed between the pushing protrusion and the rachet for receiving said locking projection.

4. The electrical connector as claimed in claim 1, wherein said pulling tab is made of high performance nylon material and has preferable flexible.

5. The electrical connector as claimed in claim 1, wherein said electrical connector defines at least one L-shaped mating port therein communicating with said contacts.

6. The electrical connector as claimed in claim 5, further comprising a first connector and a second connector back to back assembled to and electrically connecting with the first connector.

7. An electrical connector comprising:

an insulating housing having a plurality of contacts mounted therein, the housing having an aperture at a first end, a lock at a second end opposite to the first end, and a pair of limiting projections formed on top and bottom surfaces of the aperture; and a pulling tab attached to the housing and including a stop at a first end and a latch at a second end, and said stop further comprising a bulge projecting beyond a top and a bottom surfaces of the first end of the pulling tab;

wherein the latch passes through the aperture and engages with the lock; and wherein the stop is retained in the first end of the housing with the bulge engaging with a pair of limiting projections.

8. The electrical connector as claimed in claim 7, wherein said stop of the pulling tab further comprises a pair of positioning ridges protruding from the top and the bottom surfaces of the first end of the housing for positioning said stop, and a pair of recesses each formed between a corresponding bulge and a corresponding positioning ridge for receiving the limiting projection.

9. The electrical connector as claimed in claim 8, wherein said positioning ridges each have a sloped surface facing toward a rear of said second end of the pulling tab for facilitating the pair of limiting projections to pass.

10. The electrical connector as claimed in claim 8, wherein a through slit is defined below the positioning ridge for enhancing flexibility of the ridges.

11. An electrical connector assembly comprising:

an insulative housing extending along a longitudinal direction, said housing defining first and second sections along said longitudinal direction and opposite front and rear faces thereof in a front-to-back direction perpendicular to said longitudinal direction;

first and second groups of contacts disposed in the first and second sections, respectively;

the first section and the second section defining first and second mating ports on the front face mateable with a complementary connector along the front-to-back direction;

the first section defining a third mating port on the rear face;

a cable integrally connecting to the second section on the rear face; and a pulling tab linked to two ends of the housing and disposed on a rear side of the housing; wherein in operation, said pulling tab extends in said front-to-back direction so as to be essentially coplanar with the first and second mating ports in said front-to-back direction for easy withdrawing the housing from the complementary connector.

12. The connector assembly as claimed in claim 11, wherein said third mating port is mateable with another complementary connector in said front-to-back direction.

13. The connector assembly as claimed in claim 11, wherein said cable extends essentially along a vertical direction perpendicular to both said longitudinal direction and said front-to-back direction.

14. The connector assembly as claimed in claim 13, wherein said pulling tab cooperates with the rear face of the housing to essentially enclose said cable therein in said front-to-back direction.

* * * * *